United States Patent [19]

Owens

[11] 4,059,915

[45] Nov. 29, 1977

[54] SIGN ASSEMBLY

[76] Inventor: Frances R. Owens, Rte. 2, Austell, Ga. 30001

[21] Appl. No.: 693,477

[22] Filed: June 7, 1976

[51] Int. Cl.[2] ..... G09F 1/00

[52] U.S. Cl. ..... 40/125 H; 40/145 R

[58] Field of Search ..... 40/125 J, 125 R, 145 R, 40/125 H, 125 G, 128, 125 N, 125 F

[56] References Cited

U.S. PATENT DOCUMENTS

| | | | |
|---|---|---|---|
| 995,281 | 6/1911 | Nourse | 40/125 R |
| 1,374,471 | 4/1921 | Reynard | 40/145 R |
| 1,901,879 | 3/1933 | Schiffmann | 40/145 R |
| 2,188,466 | 1/1940 | Willemain | 40/125 R |
| 3,200,786 | 8/1965 | Swezy et al. | 40/125 N X |

FOREIGN PATENT DOCUMENTS

| | | | |
|---|---|---|---|
| 544,179 | 2/1932 | Germany | 40/145 R |

*Primary Examiner*—Louis G. Mancene
*Assistant Examiner*—Wenceslao J. Contreras
*Attorney, Agent, or Firm*—Newton, Hopkins & Orsmby

[57] ABSTRACT

A sign assembly comprising a sign standard which can be mounted into the ground for integrally supporting thereon a sign which can be rotated into a compact shape when not in use. One embodiment includes the sign being formed of interconnected, hinged sections which fold inwardly toward each other; another embodiment includes the sign being formed of a flexible material which can be rolled onto itself when not in use; the sign is accordion-pleated in another embodiment. When in their collapsed position, the collapsible sign embodiments are rotated into longitudinal alignment with the standard. A further embodiment includes the sign being of unitary rigid design with its transverse dimension being greater than its height.

4 Claims, 9 Drawing Figures

SIGN ASSEMBLY

BACKGROUND OF THE INVENTION

1. Field of the Invention

This invention relates to signs and sign standards and more particularly to a combination sign standard integrally supporting thereon a rotatable sign.

2. Description of Prior Art

In the selling of residences, it is common to see "For Sale" signs prominently displayed in front of the homes. Those signs usually comprise a metal standard which can be secured into the ground and a metal sign which is detachably secured to the standard, the sign bearing the name of the realty company which is acting as a sales agent for the home. These signs are heavy and bulky and require a certain amount of time to assemble and disassemble them, including bolting the sign to the standard.

There are patents which include a combination foldable sign and support such as U.S. Pat. No. 2,793,453, issued to Bixby; and patents for sign holders or standards, such as U.S. Pat. No. 3,847,335, issued to Ross. U.S. Pat. No. 3,143,817, issued to Paulson shows a sign holder which can be secured into the ground.

SUMMARY OF THE INVENTION

The above disadvantages are overcome by the present invention which is a sign assembly comprising a standard which can engage the ground about one of its ends for maintaining the standard in an upright position and a sign mounted on the standard between an extended position to display advertising indicia or the like and a stored position wherein the sign is placed in longitudinal alignment with the standard.

The standard has a forked portion formed on the bottom end which enters the ground, the portion having outwardly flared shoulders so that the user can place his foot thereon to drive the standard downwardly into the ground.

One embodiment of the sign includes a plurality of rigid, interconnected, hinged sections with the middle section being rotatably secured through its center to the standard. The top and bottom sections have openings which engage respective protrusions or hooks on the standard to prevent the sign from rotating when it is in its extended position. When it is desired to store the sign, the top and bottom sections are disengaged from the protrusions and those sections are folded inwardly toward the secured or middle section. The sign is then manually rotated such that it is in longitudinal alignment with the standard and is retained in its collapsed position by means of straps which are mounted on the standard.

Another embodiment of the sign includes it being formed of a flexible material and has tensioning bars transversely extending along its top and bottom to provide inflexibility to the sign along its longitudinal direction when the sign is in the display position. The sign is mounted along its bottom end on the standard and is further provided with an opening at its top end which engages a protrusion or hook on the standard when the sign is in its extended position. When it is desired to place the sign in its collapsed position, the sign is released from the protrusion and allowed to roll onto itself toward its bottom end. The sign is then manually rotated into longitudinal alignment with the standard and retained in that position by means of the aforesaid straps.

A third embodiment includes the sign being formed of a plurality rectangular sections which are interconnected along score lines to fold in an accordion-like fashion, the sign being pivotally mounted through its center on the standard.

Another embodiment has the sign being a rigid, arrow-shaped unit which is pivotally mounted on the standard.

An object of the present invention is to provide a sign assembly which has a sign integrally connected to a standard which can be secured into the ground, the sign being readily adapted to be collapsed from a display position.

Another object of the present invention is to provide a sign assembly which is lightweight, impervious to the weather and which provides a sign which is readily placed between a display position and a collapsed position.

DESCRIPTION OF THE PREFERRED EMBODIMENTS

A. First Embodiment

Figure 1:
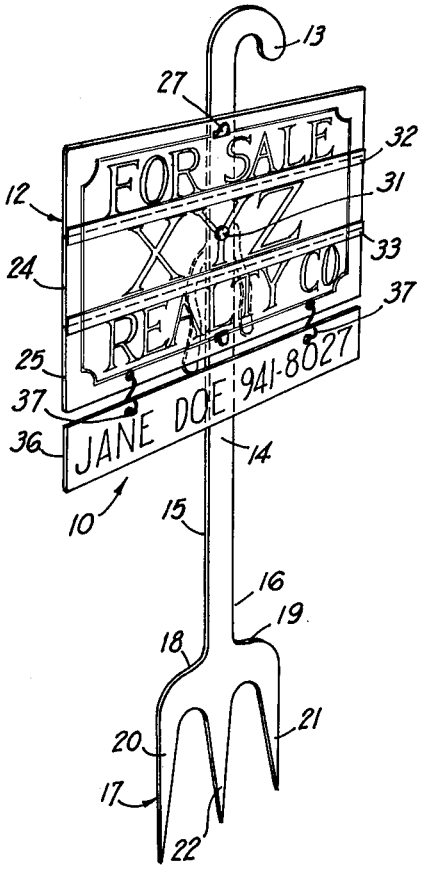
FIG. 1 is a perspective view of the invention illustrating one embodiment of the sign.

The first embodiment of the sign assembly of this invention is referred to generally in FIG. 1 by the reference numeral 10 and includes a sign standard 11 and sign 12.

Standard 11 is a substantially flat structure formed of any suitable lightweight material, such as plastic, and has a curved top portion 13 which is integral with a depending, elongated portion 14 having generally parallel sides 15, 16. Portion 14 terminates in a forked portion 17 which includes sides 15, 16 flaring outwardly to form shoulders 18, 19 respectively, which terminate in depending tines 20, 21. A tine 22 is integrally formed in portion 17 between tines 20 and 21.

The embodiment of the sign 12 as shown in FIGS. 1 - 4 includes it being formed of a plurality of rigid, interconnected rectangular sections. The sign 12 is illustrated as being formed of three such sections, top section 23, middle section 24 and bottom section 25. The assembly 10 is provided with means for securing the sign 12 in its extended or display position as shown in FIG. 1 and includes the combination of a hook and an opening in engagement with the hook. Section 23 is provided with an opening 26 which is in registration with a hook 27 integrally formed on portion 14. The opening 26 is centrally located on section 23 adjacent the top end of that section.

A corresponding hook and opening combination is provided for section 25 with hook 29 being formed on portion 14 for engagement with opening 30 on section 25.

The sign 12 is supported on standard 11 by means of a pin 31 being centrally mounted through section 24 and portion 14. The sign 12 may be pivoted about 31, as will be described in detail hereinbelow.

Sections 23, 24, 25 are interconnected by means of hinging elements 32, 33 which are secured to the bottom of section 23 and top of section 24, the bottom of section 24 and the top of section 25, respectively. The elements 32, 33 are flexible to allow sections 23, 25 to fold onto section 24.

Figure 3:
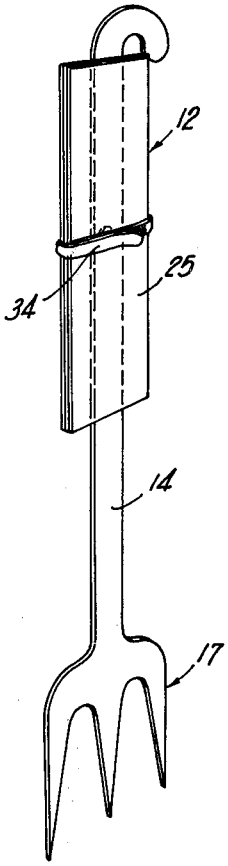
FIG. 3 is a perspective view illustrating the sign of the first embodiment in a collapsed and retained position.

Means is provided on standard 11 for retaining the sign 12 in its collapsed position as shown in FIG. 3 and includes flexible straps 34, 35 which are secured on the rear of portion 14 by means of pin 31. A section of intermeshing fastening elements, such as produced under the trademark VELCRO, are provided on the ends of straps 34, 35. The assembly 10 can be utilized for realty signs so that when the assembly 10 is placed in front of a home, each section 23, 24, 25 would bear indicia thereon which would advertise the fact that the home is for sale by a particular realty company.

As shown in FIG. 1, the assembly 10 can optionally include a section 36 which can be detachably connected to sign 12 by means of a pair of hooks 37 which are detachably mounted along the bottom of section 25 to engage holes provided adjacent the upper edge of section 36. Section 36 would include such information as the name of the particular realtor handling the sale of the home. In that manner, the sign 12 could be utilized by any realtor within the realty company and each realtor would have his own section 36 to attach to sign 12.

B. Operation of First Embodiment

As shown in FIG. 1, the sign 12 is in an extended or display position. By grasping portion 13, the user could insert portion 17 into the ground by placing his foot on either shoulder 18 or 19 and pressing downwardly, thereby driving tines 20, 21, 22 into the ground to place standard 11 in an erect position. In the display position, the hooks 27, 29 engage openings 26, 30 respectively, thereby securing the sign 12 in its display position and preventing the sign 12 from rotating about pin 31.

Figure 2:
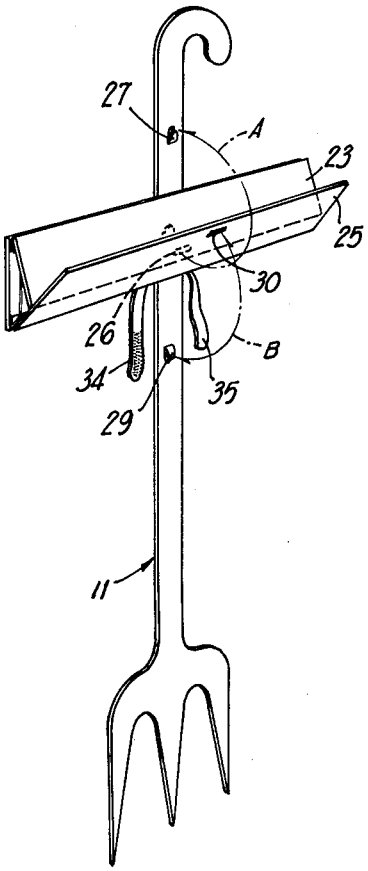
FIG. 2 is a perspective view illustrating the sign being placed in a collapsed position.
Figure 4:
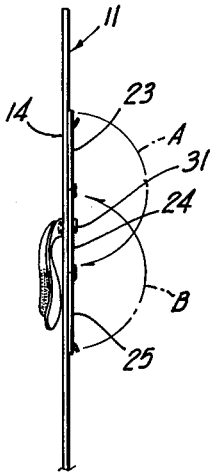
FIG. 4 is a fragmentary side elevational view of FIG. 1.

When it is desired to place the sign 12 in a collapsed position, section 36 is disengaged from the hooks 37, if the section 36 is utilized. Then, the hooks 37 are removed from section 25. FIGS. 2 – 4 are shown without reference to section 36 or hooks 37. The next step is to disengage section 23 from hook 27 and, by means of hinging element 32, allow section 23 to fold downwardly on section 24 along arrow A as shown in FIGS. 2 and 4. Section 25 is disengaged from hook 29 and manually moved upwardly along the path of arrow B in FIGS. 2 and 4 to assume the position as shown in FIG. 2. The sign 12 is then manually rotated about pin 31 either to the left or to the right so that it is in longitudinal alignment with portion 14, as shown in FIG. 3. Straps 34, 35 are brought from opposite sides around sign 12 so as to retain the sign 12 in a collapsed position, as shown in FIG. 3, thereby preventing rotation of the sign 12 about pin 31. The standard 11 is then removed from the ground by grasping portion 13 and pulling upwardly. The assembly 10 may be conveniently stored for further use by hanging it on a hook protruding from an upright surface by means of curved portion 13.

C. Second Embodiment

Figure 5:
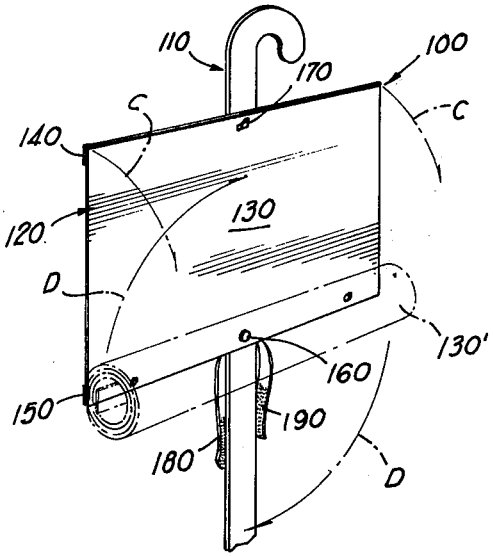
FIG. 5 is a fragmentary perspective view of the second embodiment of the present invention.

The second embodiment of the present invention is shown in FIG. 5 and is referred to generally by numeral 100. The standard 110 is identical in construction to standard 11 described above.

Sign 120 is a unitary, generally rectangular shaped element 130 constructed of any suitable flexible, weather-proof material. Means is provided for tensioning the sign 120 when it is in its extended or display position and include rigid bars 140, 150 which transversely extend along and are secured by any suitable means to the rear of the top and bottom edges of element 130.

The sign 120 is pivotally secured to standard 110 by means of a pin 160 which extends through element 130 adjacent its lower end, through bar 150 and through standard 110. Means is provided for securing element 130 in a display position and include an opening through the center portion of element 130 adjacent its top end and through bar 140, the opening being in registration with protrusion 170 which is integrally formed on standard 110.

Means is provided for retaining the sign 120 in its collapsed position and include straps 180, 190 which are secured on the back side of standard 110 by means of pin 160. Straps 180, 190 are similar in construction to straps 34, 35 described above.

D. Operation of Second Embodiment

The sign 120 is shown in its extended or display position in solid lines in FIG. 5. Suitable advertising indicia would be displayed on element 130. The opening in element 130 which is in engagement with protrusion 170 prevents the sign 120 from rotating about pin 160 as well as keeping the element 130 substantially rigid.

When it is desired to place the sign 120 in its collapsed position, the element 130 is disengaged from protrusion 170 and allowed to fold inwardly on itself along the direction of arrows C so that it assumes the position as shown in dashed lines as 130′. The sign 130′ is then manually rotated as in the direction of arrows D such that it assumes longitudinal alignment with standard 110. Straps 180, 190 are secured around element 130′ in a fashion which is similar to that shown in FIG. 3 for sign 12. The standard 110 can then be removed from the ground.

Figure 6:
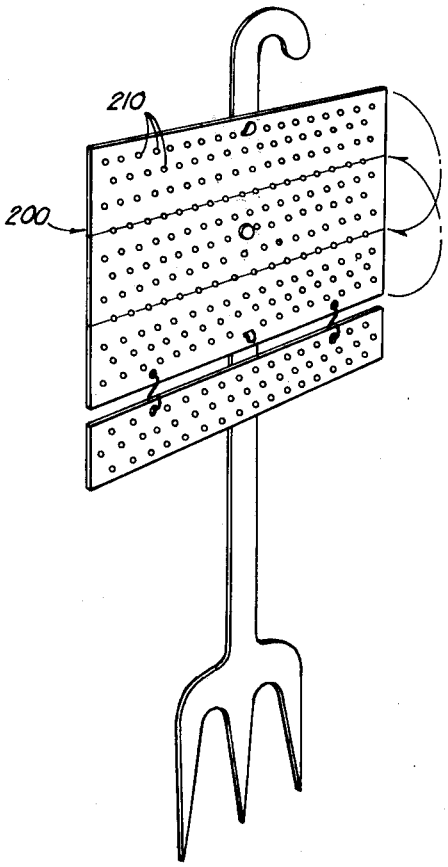
FIG. 6 is a perspective view illustrating a perforated sign.

All of the sign embodiments of the present invention include the sign being perforated, as shown in FIG. 6 and designated 200. The perforations 210 serve to allow the wind to pass therethrough, and thus prevent the signs from being blown down by gusts of high winds. The sign 200 illustrated in FIG. 6 has the same construction as sign 12 shown in FIGS. 1 – 3.

E. Third Embodiment

Figure 7:
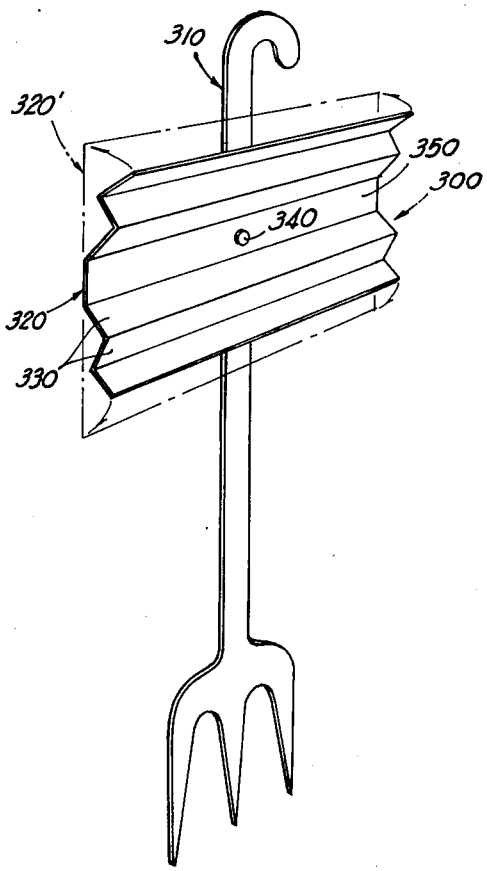
FIG. 7 is a perspective view of the third embodiment of the present invention.

The third embodiment of the sign assembly of the present invention is illustrated in FIG. 7 as 300 and includes sign standard 310 which is similar in design and construction to the standards 11 and 110 discussed above. The sign 320 of the third embodiment is comprised of a plurality of rectangular-shaped, rigid segments 330 which are connected together across their respective top and bottom ends by score lines so as to fold in accordion-like fashion when placed in a collapsed position. The sign 320 is shown in FIG. 7 in a partially collapsed altitude, but it is secured in its extended position which is shown in broken lines as 320' by means of the hook and opening combination (not shown) as disclosed for the first embodiment.

The sign 320 is rotatably mounted on standard 310 by means of pin 340 being centrally located through middle segment 350 and through standard 310.

To place the sign 320 in its collapsed position, those segments 330 which are above segment 350 are folded downwardly, one on top of the other onto middle semgent 350; those segments 330 which are below segment 350 are folded upwardly onto segment 350. The collapsed sign 320 may then be rotated about pin 340 so that it is in longitudinal alignment with standard 310 and may be retained in that position by straps (not shown) similar to straps 34, 35 and 180, 190 dicussed above. Standard 310 may then be removed from the ground and the assembly 300 conveniently stored.

F. Fourth Embodiment

Figure 8:
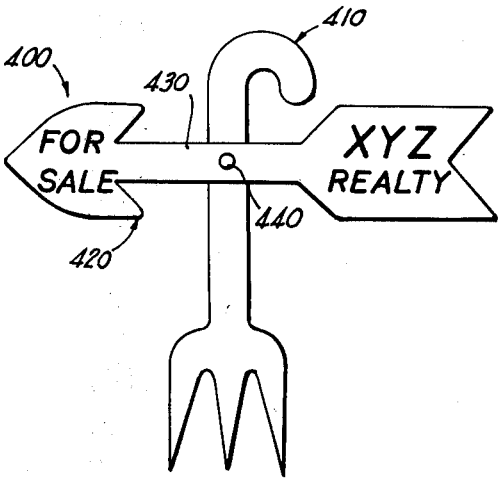
FIG. 8 is a front elevational view of the fourth embodiment of the present invention.
Figure 9:
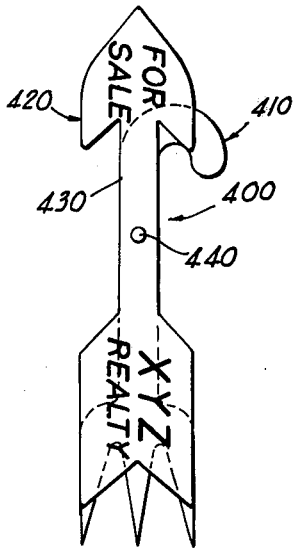
FIG. 9 is a front elevational view illustrating the sign of the fourth embodiment in a stored position.

The fourth embodiment of the present invention is illustrated in FIGS. 8 and 9 as sign assembly 400 and includes a standard 410 and sign 420.

The standard 410 is similar in design to the previously mentioned standards 11, 110 and 310, but is illustrated as being relatively shorter than those standards with the various portions of standard 410 being wider in dimension than the above discussed standards.

The sign 420 is a unitary, rigid arrow-shaped unit which is centrally mounted through shaft 430 on standard 410 by means of pin 440. The sign 420 may be retained in its horizontal alignment as shown in FIG. 8 by means of the frictional engagement of pin 440 with shaft 430. As illustrated, the sign 420 can be utilized by realtors in residential neighborhoods to direct potential home buyers to a residence that is for sale by that particular realtor or realtor company.

The assembly 400 is shown in its stored position in FIG. 9 whereby sign 420 has been rotated about pin 440 until sign 420 assumes a vertical or upright position, thereby being in longitudinal alignment with the standard 410.

What is claimed is:

1. A sign assembly comprising, in combination:

a. a standard including a curved upper portion, a lower portion having means thereon for engaging the ground to support said standard in an upright position and an elongated portion interconnecting said upper portion and said lower portipn;

b. a sign adapted to receive indicia for display rotatably mounted on said elongated portion between a display position and a stored position wherein said sign is in longitudinal alignment with said elongated portion and wherein said sign comprises a plurality of rigid, rectangular, foldably interconnected sections, said sign being secured in said display position by means of a combination on said sign and said standard of a protrusion and opening in mating engagement with said protrusion, and said sign being supported on said standard through one of said sections such that when said securing means is manually disengaged, the remaining sections are foldable onto said secured section for rotation into said stored position.

2. A sign assembly claimed in claim 1 wherein said standard is provided with means for retaining said sign in said stored position, said retaining means including a strap mounted on said standard opposite said sign and which is secured about said sign when it is in longitudinal alignment with said standard.

3. A sign assembly as claimed in claim 1 wherein said securing means includes an opening centrally located on each of the uppermost and lowermost sections of said sign and a protrusion on said standard in registration with each of said openings.

4. A sign capable of being rotatably supported on a sign standard between a display position and a collapsed position in longitudinal alignment with said standard, comprising: a plurality of rigid, rectangular sections which are hingingly connected along adjacent transverse sides of said sections, said sign being secured in said display position whereby said sections are aligned within a vertical plane by means of a combination on said sign and said standard of a protrusion and opening in mating engagement with said protrusion, and said sign being supported on said standard through one of said sections such that when said securing means is manually disengaged, the remaining sections are foldable into said collapsed position onto said one section.

* * * * *